US009204238B2

(12) United States Patent
Lin

(10) Patent No.: US 9,204,238 B2
(45) Date of Patent: Dec. 1, 2015

(54) ELECTRONIC DEVICE AND METHOD FOR REPRODUCING SURROUND AUDIO SIGNAL

(71) Applicant: Chiun Mai Communication Systems, Inc., New Taipei (TW)

(72) Inventor: Chih-Ta Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 179 days.

(21) Appl. No.: 14/064,228

(22) Filed: Oct. 28, 2013

(65) Prior Publication Data

US 2014/0321678 A1 Oct. 30, 2014

(30) Foreign Application Priority Data

Apr. 30, 2013 (TW) ..... 102115559 A

(51) Int. Cl.
*H04S 7/00* (2006.01)

(52) U.S. Cl.
CPC ..... *H04S 7/30* (2013.01)

(58) Field of Classification Search
CPC ..... H04R 5/02; H04R 5/04; H04R 3/12; H04R 2499/15; H04R 2205/022; H04R 1/403
USPC ..... 381/300
See application file for complete search history.

(56) References Cited

U.S. PATENT DOCUMENTS

| | | | | |
|---|---|---|---|---|
| 8,270,631 | B2 * | 9/2012 | Kusunoki | 381/85 |
| 8,705,748 | B2 * | 4/2014 | Walsh | 381/17 |
| 8,705,750 | B2 * | 4/2014 | Berge | 381/22 |
| 8,885,834 | B2 * | 11/2014 | Kuhr et al. | 381/17 |

* cited by examiner

*Primary Examiner* — Mark Blouin
(74) *Attorney, Agent, or Firm* — Novak Druce Connolly Bove + Quigg LLP

(57) ABSTRACT

A method for reproducing a surround audio signal using an electronic device. The electronic device first establishes connections between the electronic device and other N−1 electronic devices, once the electronic device sets each of the N electronic devices to output one of the N channel signals according to one-to-one relationships, the electronic device controls a speaker of each of the N electronic devices to output the corresponding channel signal, to reproduce the surround audio signal.

9 Claims, 4 Drawing Sheets

ELECTRONIC DEVICE AND METHOD FOR REPRODUCING SURROUND AUDIO SIGNAL

BACKGROUND

1. Technical Field

Embodiments of the present disclosure relates to audio file processing technology, and more particularly to an electronic device and a method for processing a multichannel audio file using the electronic device.

2. Description of Related Art

An electronic device (e.g., a mobile phone) cannot reproduce a surround audio signal as a number of speakers configured in the electronic device is limited. Therefore, there is room for improvement in the art.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

In general, the word module, as used herein, refers to logic embodied in hardware or firmware, or to a collection of software instructions, written in a programming language, such as, Java, C, or assembly. One or more software instructions in the modules may be embedded in firmware, such as in an EPROM. The modules described herein may be implemented as either software and/or hardware modules and may be stored in any type of non-transitory computer-readable medium or other storage device. Some non-limiting examples of non-transitory computer-readable media include CDs, DVDs, BLU-RAY, flash memory, and hard disk drives.

Figure 1:
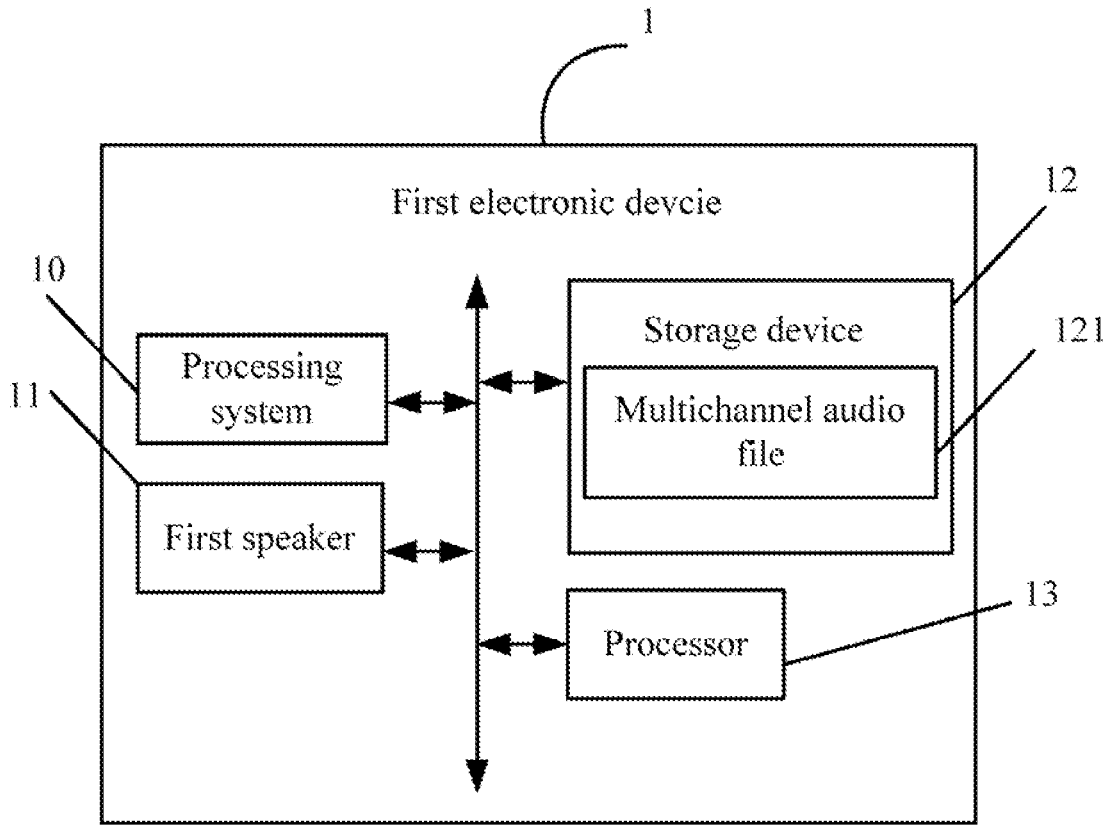
FIG. 1 is a block diagram of one embodiment of an electronic device including a processing system.

FIG. 1 is a block diagram of one embodiment of a first electronic device 1 including a processing system 10. In this embodiment, the first electronic device 1 further includes a first speaker 11, a storage device 12, and at least one processor 13. The processing system 10 prestores a multichannel audio file 121 in the storage device 12, where the multichannel audio file 121 includes N channel signals.

The multichannel audio file 121 is a 4.1 channel audio file, a 5.1 channel audio file, a 6.1 channel audio file, or a 7.1 channel audio file, for example. That is, the N may be equal to five, six, seven, or eight.

The processing system 10 reproduces a surround audio signal by controlling N electronic devices to output a respective N channel signal. In one embodiment, the N electronic devices may be mobile phones, tablet personal computers, and/or other portable electronic devices.

For example, if the multichannel audio file 121 is the 5.1 channel audio file, that is, the multichannel audio file 121 includes six channel signals. Then the processing system 10 reproduces the surround audio signal by controlling six electronic devices to output the six channel signal respectively.

Figure 2:
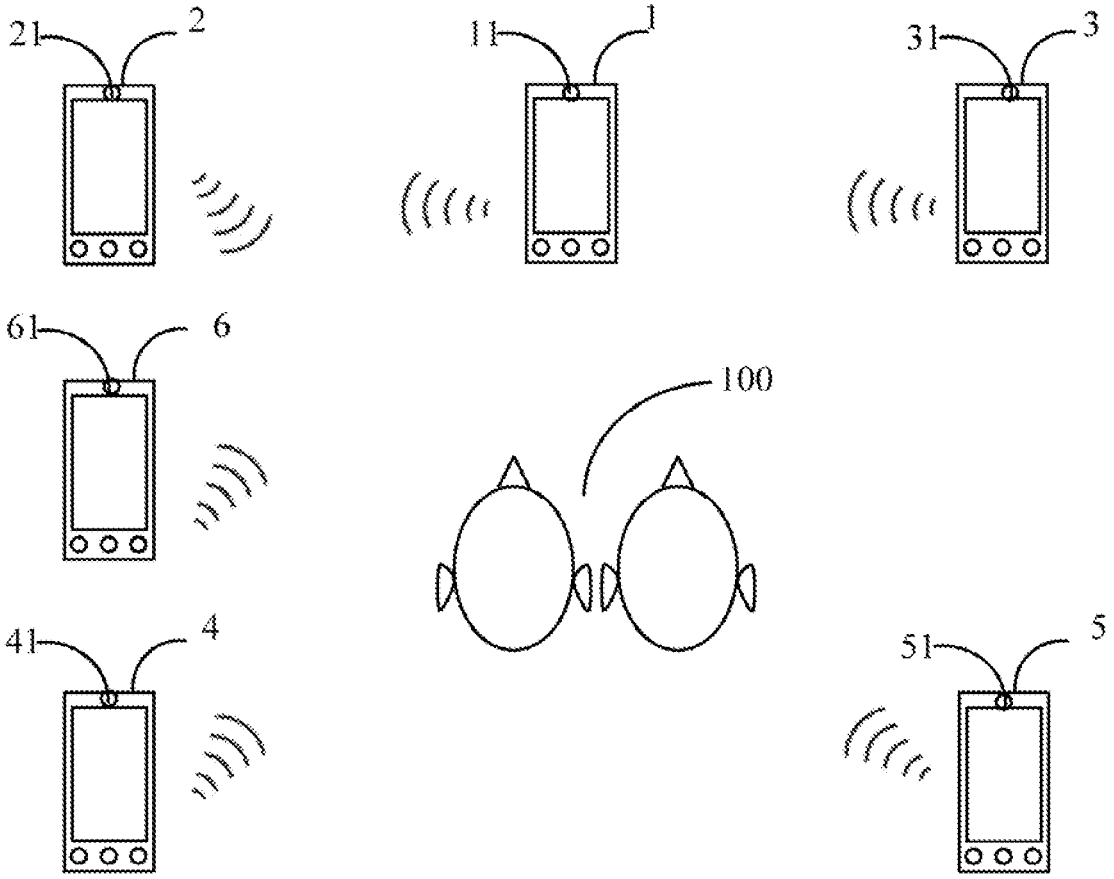
FIG. 2 illustrates one example of a 5.1 surround environment.

For example, as shown in FIG. 2, the processing system 10 reproduces the surround audio signal by controlling the first electronic device 1 which includes the first speaker 11, a second electronic device 2 which includes a second speaker 21, a third electronic device 3 which includes a third speaker 31, a fourth electronic device 4 which includes a fourth speaker 41, a fifth electronic device 5 which includes a fifth speaker 51, and a sixth electronic device 6 which includes a sixth speaker 61, to output the six channel signal respectively. Details will be given below.

Figure 3:
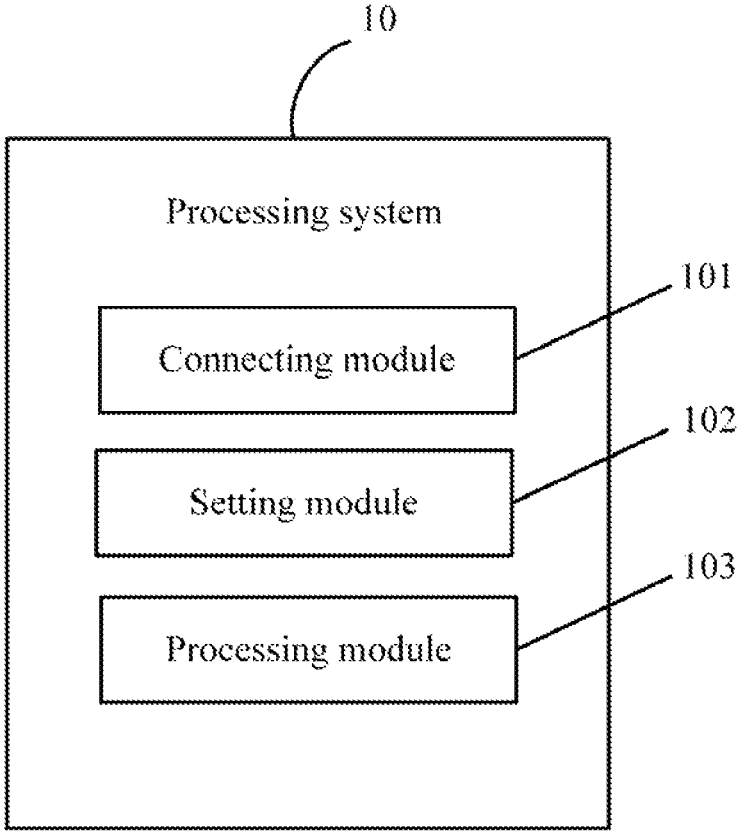
FIG. 3 is a block diagram of function modules of the processing system included in the electronic device of FIG. 1.

FIG. 3 is a block diagram of function modules of the processing system 10 included in the first electronic device 1 of FIG. 1. In this embodiment, the processing system 10 may include a connecting module 101, a setting module 102, and a processing module 103. The modules 101-103 comprise computerized codes in the form of one or more programs that may be stored in the storage device 12. The computerized code includes instructions that are executed by the at least one processor 13.

Figure 4:
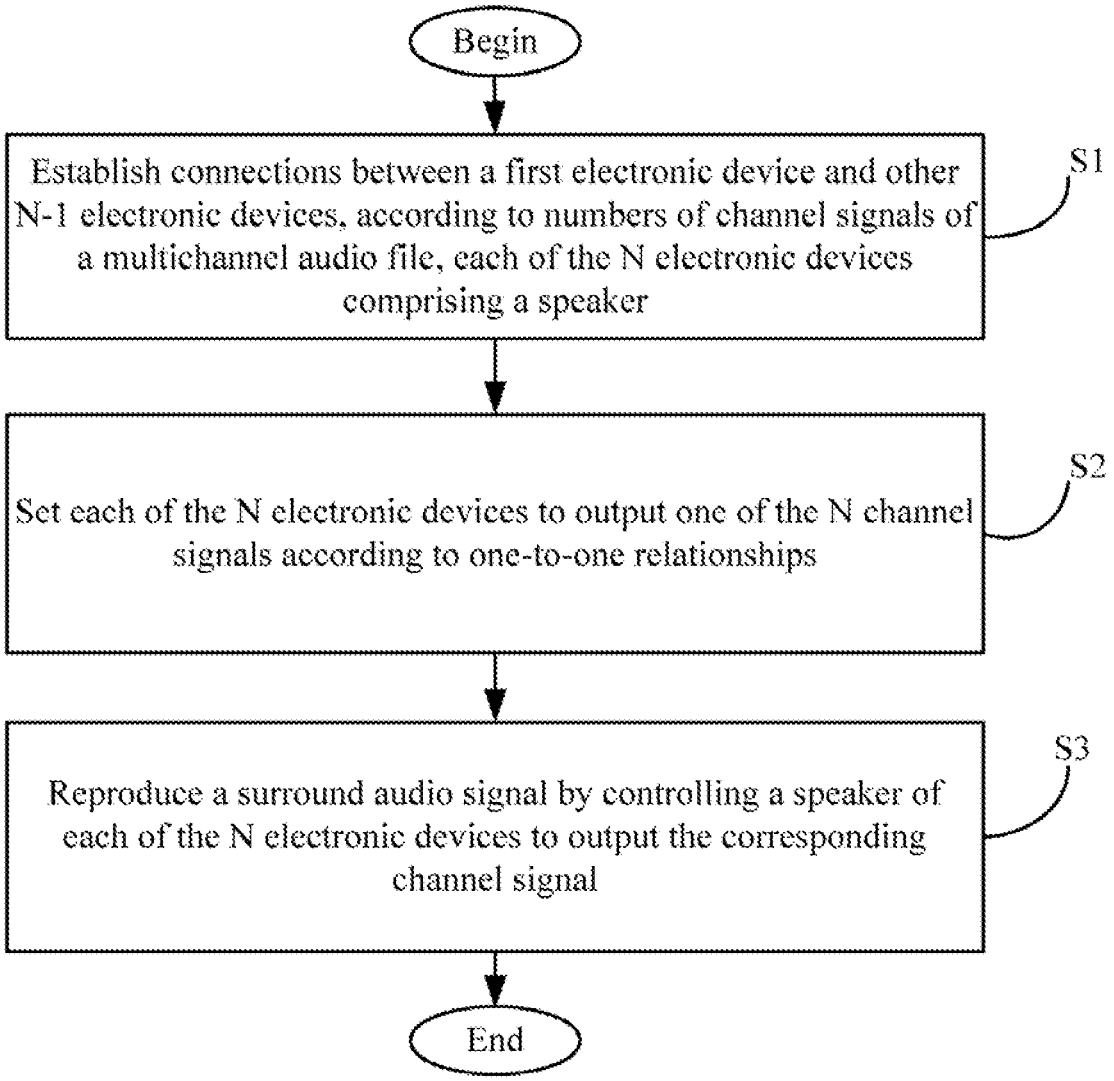
FIG. 4 is a flowchart of one embodiment of a processing method to process a multichannel audio file.

FIG. 4 is a flowchart of one embodiment of a processing method to process the multichannel audio file 121. Depending on the embodiment, additional steps may be added, others deleted, and the ordering of the steps may be changed.

In step S1, the connecting module 101 establishes connections between the first electronic device 1 and other N−1 electronic devices, according to a number of the channel signals of the multichannel audio file 121.

For example, if the multichannel audio file 121 is the 5.1 channel audio file, that is, the multichannel audio file 121 includes six channel signals, and the six channel signals include a center channel signal, a left channel signal, a right channel signal, a left surround channel signal, a right surround channel signal, and a Low Frequency Effects (LFE) channel signal Then the connecting module 101 establishes connections between the first electronic device 1 and other five electronic devices (e.g., the second electronic device 2, the third electronic device 3, the fourth electronic device 4, the fifth electronic device 5, and the sixth electronic device 6).

In step S2, the setting module 102 sets each of the N electronic devices to output one of the N channel signals according to one-to-one relationships.

That is, the setting module 102 sets each of the N electronic devices to uniquely correspond to one of the N channel signals, and each of the N channel signals to uniquely correspond to one of the N electronic devices.

For example, the setting module 102 sets the first electronic device 1 to output the center channel signal, sets the second electronic device 2 to output the left channel signal, sets the third electronic device 3 to output the right channel signal, sets the fourth electronic device 4 to output the left surround channel signal, sets the fifth electronic device 5 to output the right surround channel signal, and sets the sixth electronic device 6 to output the LFE channel signal.

To ensure outputting better surround audio signals in a surrounding environment, orientations of the N electronic devices in the surrounding environment are determined according to the corresponding channel signals.

For example, in a 5.1 surrounding environment, the first electronic device 1 is positioned in front of the audience 100, as the first electronic device 1 is set to output the center channel signal. In another example, the first electronic device 1 may be positioned in upper left of the audience 100, if the first electronic device 1 is set to be output the left channel signal.

In step S3, the processing module 103 reproduces the surround audio signal by controlling the speaker of each of the N electronic devices to output the corresponding channel signal.

For example, the processing module 103 reproduces the surround audio signal by controlling the first speak 11 to output the center channel signal, controlling the second speaker 12 to output the left channel signal, controlling the third speaker 13 to output the right channel signal, controlling the fourth speaker 14 to output the left surround channel signal, controlling the fifth speaker 15 to output the right surround channel signal, and controlling the sixth speaker 16 to output the LFE channel signal.

Although embodiments of the present disclosure have been specifically described, the present disclosure is not to be construed as being limited thereto. Various changes or modifications may be made to the present disclosure without departing from the scope and spirit of the present disclosure.

What is claimed is:

1. A method for reproducing a surround audio signal using an electronic device, the electronic device comprising a storage device and at least one processor, the storage device storing a multichannel audio file which comprises N channel signals, the method comprising:

establishing connections between the electronic device and other N−1 electronic devices, each of the N electronic devices comprising a speaker;

setting each of the N electronic devices to output one of the N channel signals according to one-to-one relationships; and reproducing the surround audio signal by controlling the speaker of each of the N electronic devices to output the corresponding channel signal.

2. The method of claim 1, wherein the multichannel audio file is a 4.1 channel audio file, a 5.1 channel audio file, a 6.1 channel audio file, or a 7.1 channel audio file.

3. The method of claim 1, wherein orientations of the N electronic devices in a surrounding environment are determined according to the corresponding channel signals.

4. An electronic device comprising:

at least one processor; and a storage device storing a plurality of instructions, which when executed by the processor, causes the processor to:

establish connections between the electronic device and other N−1 electronic devices, each of the N electronic devices comprising a speaker;

set each of the N electronic devices to output one of the N channel signals according to one-to-one relationships; and reproduce the surround audio signal by controlling the speaker of each of the N electronic devices to output the corresponding channel signal.

5. The electronic device of claim 4, wherein the multichannel audio file is a 4.1 channel audio file, a 5.1 channel audio file, a 6.1 channel audio file, or a 7.1 channel audio file.

6. The electronic device of claim 4, wherein orientations of the N electronic devices in a surrounding environment are determined according to the corresponding channel signals.

7. A non-transitory storage medium having stored thereon instructions that, when executed by a processor of an electronic device, causes the electronic device to perform a method for reproducing a surround audio signal, the electronic device further comprising a storage device, the storage device storing a multichannel audio file which comprises N channel signals, the method comprising:

establishing connections between the electronic device and other N−1 electronic devices, each of the N electronic devices comprising a speaker;

setting each of the N electronic devices to output one of the N channel signals according to one-to-one relationships; and reproducing the surround audio signal by controlling the speaker of each of the N electronic devices to output the corresponding channel signal.

8. The non-transitory storage medium of claim 7, wherein the multichannel audio file is a 4.1 channel audio file, a 5.1 channel audio file, a 6.1 channel audio file, or a 7.1 channel audio file.

9. The non-transitory storage medium of claim 7, wherein orientations of the N electronic devices in a surrounding environment are determined according to the corresponding channel signals.

* * * * *